US008378245B2

(12) United States Patent
Fischer

(10) Patent No.: US 8,378,245 B2
(45) Date of Patent: Feb. 19, 2013

(54) ELECTRICAL SWITCHING APPARATUS, AND HANDLE ASSEMBLY AND PUSH-TO-TRIP MECHANISM THEREFOR

(75) Inventor: Kenneth Martin Fischer, Finleyville, PA (US)

(73) Assignee: Eaton Corporation, Cleveland, OH (US)

( * ) Notice: Subject to any disclaimer, the term of this patent is extended or adjusted under 35 U.S.C. 154(b) by 337 days.

(21) Appl. No.: 12/852,840

(22) Filed: Aug. 9, 2010

(65) Prior Publication Data

US 2012/0031745 A1 Feb. 9, 2012

(51) Int. Cl.
*H01H 5/00* (2006.01)

(52) U.S. Cl. ..... 200/400; 200/329; 218/154

(58) Field of Classification Search ..... 200/329–341, 200/50.21–50.28, 400, 401; 218/152–154; 335/165–176

See application file for complete search history.

(56) References Cited

U.S. PATENT DOCUMENTS 3,895,205 A 7/1975 Tharp
4,713,639 A 12/1987 Grunert et al.
5,004,994 A 4/1991 Korczynski et al.
5,576,677 A * 11/1996 Malingowski et al. ..... 335/172
6,194,983 B1 2/2001 Bogdon et al.
6,504,460 B2 1/2003 DeGrazia et al.
7,186,933 B2 3/2007 Turner
7,238,903 B2 7/2007 Fischer
2009/0301850 A1 12/2009 Puhalla et al.

* cited by examiner

*Primary Examiner* — Amy Cohen Johnson
*Assistant Examiner* — Marina Fishman
(74) *Attorney, Agent, or Firm* — Eckert Seamans Cherin & Mellott, LLC; Grant E. Coffield

(57) ABSTRACT

A push-to-trip mechanism is provided for a handle assembly for an electrical switching apparatus, such as circuit breaker. The handle assembly includes a casing coupled to the exterior of the circuit breaker housing over the push-to-trip button of the circuit breaker. The push-to-trip mechanism includes an actuating member at least partially disposed within an aperture of the casing. The actuating member is movable between an actuated position corresponding to the actuating member actuating the push-to-trip button, and an unactuated position corresponding to the actuating member not actuating the push-to-trip button. A resilient element biases the actuating member toward the unactuated position. The push-to-trip mechanism is operable from the exterior of the handle assembly casing, thereby enabling the push-to-trip button of the circuit breaker to be actuated, without removing the casing.

12 Claims, 4 Drawing Sheets

ELECTRICAL SWITCHING APPARATUS, AND HANDLE ASSEMBLY AND PUSH-TO-TRIP MECHANISM THEREFOR

BACKGROUND

1. Field

The disclosed concept relates generally to electrical switching apparatus and, more particularly, to electrical switching apparatus, such as a circuit breakers. The disclosed concept also relates to handle assemblies for circuit breakers. The disclosed concept further relates to push-to-trip mechanisms for handle assemblies.

2. Background Information

Electrical switching apparatus, such as circuit breakers, provide protection for electrical systems from electrical fault conditions such as, for example, current overloads, short circuits, abnormal voltage and other fault conditions. Molded case circuit breakers, for example, include at least one pair of separable contacts which are operated either manually by way of a handle disposed on the outside of the case, or automatically by way of a trip unit, in response to a trip condition.

Some circuit breakers include separately attachable handle assemblies, such as rotating handles which often serve secondary functions and include auxiliary features. For example and without limitation, in addition to providing an operating handle, the handle attachment may also serve as a status indicator (e.g., trip indicator), and it may include a handle locking device. See, e.g., U.S. Pat. Nos. 6,194,983 and 7,186,933, which are incorporated herein by reference.

FIG. 1, for example, shows a handle assembly 2 as employed on a molded case circuit breaker 4. The handle assembly 2 includes an insulating casing 6 which may be coupled to the housing 8 of the circuit breaker 4 by any suitable fastening mechanism, such as the exemplary screws 10. In the example of FIG. 1, the handle assembly 2 has a pivoting handle 12 which is operable between three positions, an ON position, an OFF position, and the intermediate tripped position, as shown. Thus, the handle attachment 2 also functions as a status or trip indicator for the circuit breaker 4. However, the casing 6 of the handle assembly 2 covers the push-to-trip button 14 of the circuit breaker 4, as shown in hidden line drawing in FIG. 1. This makes it difficult, if not impossible, to access the push-to-trip button 14, without first having to remove the handle assembly 2.

There is, therefore, room for improvement in electrical switching apparatus, such a circuit breakers, and in handle assemblies and push-to-trip mechanisms therefor.

SUMMARY

These needs and others are met by embodiments of the disclosed concept, which are directed to a push-to-trip mechanism for handle assemblies coupled to electrical switching apparatus, such as circuit breakers. Among other benefits, the push-to-trip mechanism is readily accessible from the exterior of the handle assembly, thereby providing a relatively quick and easy mechanism for activating the push-to-trip button of the circuit breaker, without requiring the handle assembly casing to be removed.

As one aspect of the disclosed concept, a push-to-trip mechanism is provided for a handle assembly for an electrical switching apparatus. The electrical switching apparatus includes a housing, separable contacts enclosed by the housing, and a push-to-trip button being operable to trip open the separable contacts. The handle assembly includes a casing having an aperture. The casing is coupled to the exterior of the housing over the push-to-trip button. The push-to-trip mechanism comprises: an actuating member structured to be at least partially disposed within the aperture of the casing, the actuating member being structured to move between an actuated position corresponding to the actuating member actuating the push-to-trip button, and an unactuated position corresponding to the actuating member not actuating the push-to-trip button; and a resilient element biasing the actuating member toward the unactuated position.

The actuating member may comprise a first end, a second end disposed opposite and distal from the first end, and an elongated intermediate portion extending between the first end and the second end. The first end may be structured to extend through the aperture of the casing to cooperate with the push-to-trip button. The second end may be structured to be accessible from the exterior of the casing. The second end of the actuating member may include an enlarged head.

As another aspect of the disclosed concept, a handle assembly is provided for an electrical switching apparatus. The electrical switching apparatus includes a housing, separable contacts enclosed by the housing, and a push-to-trip button being operable to trip open the separable contacts. The handle assembly comprises: a casing having an aperture, the casing being structured to be coupled to the exterior of the housing over the push-to-trip button; and a push-to-trip mechanism comprising: an actuating member at least partially disposed within the aperture of the casing, the actuating member being structured to move between an actuated position corresponding to the actuating member actuating the push-to-trip button, and an unactuated position corresponding to the actuating member not actuating the push-to-trip button, and a resilient element biasing the actuating member toward the unactuated position.

The actuating member may further comprise a protrusion, wherein the protrusion extends outwardly from the elongated intermediate portion, and wherein protrusion is structured to cooperate with a portion of the casing in order to position the actuating member in a desired orientation with respect to the push-to-trip button. The casing may include a first recess and a second recess, and the actuating member may be pivotable among a plurality of positions. In one of the positions the protrusion may be disposed in the first recess, and in another, different one of the positions the protrusion may be disposed in the second recess. When the protrusion is disposed in the first recess, the actuating member may be positioned in a first desired orientation and, when the protrusion is disposed in the second recess, the actuating member may be disposed in a second, different desired orientation.

An electrical switching apparatus including the aforementioned handle assembly and push-to-trip mechanism therefor is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
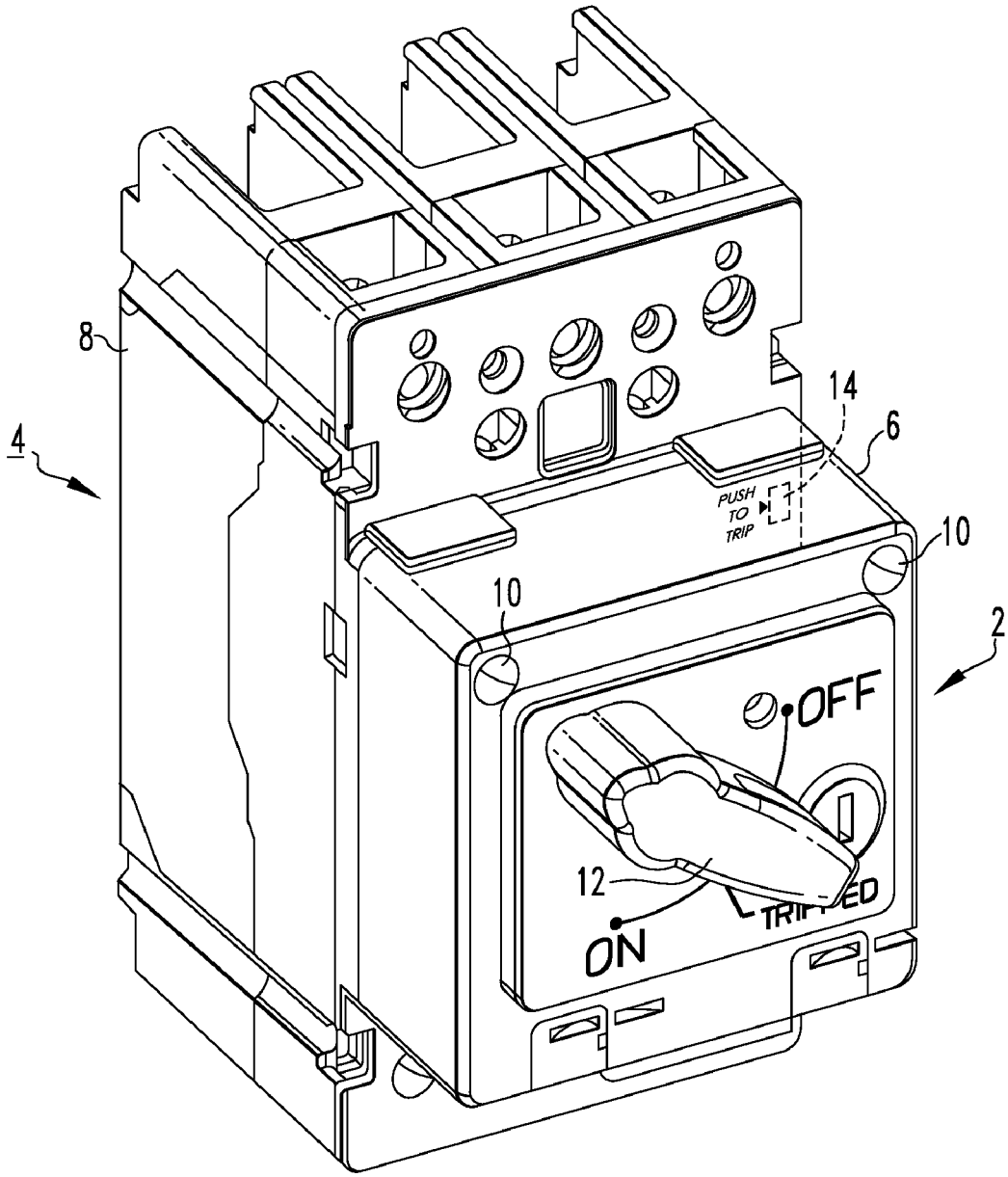
FIG.1 PRIOR ART
FIG. 1 is an isometric view of a circuit breaker having a handle assembly.

For purposes of illustration, the invention will be described and illustrated as applied to a push-to-trip mechanism for the handle assembly of a molded case circuit breaker, although it will become apparent that it could also be applied to other types of electrical switching apparatus (e.g., without limitation, circuit switching devices and other circuit interrupters such as contactors, motor starters, motor controllers and other load controllers) having an operating mechanism, and to other types of handle assemblies coupled thereto.

Directional phrases used herein, such as, for example, upward, downward and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts. A "fastening mechanism," as used herein, expressly includes, but is not limited to fasteners, as previously defined, as well as any other known or suitable means for adhering (e.g., without limitation, glue, tape, or other adhesives) two or more components together.

As employed herein, the term "trip condition" refers to any abnormal electrical condition which could cause a circuit breaker or other electrical switching apparatus to trip expressly including, without limitation, an overcurrent condition, an overload condition, an undervoltage condition, or a relatively high level short circuit or fault condition.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
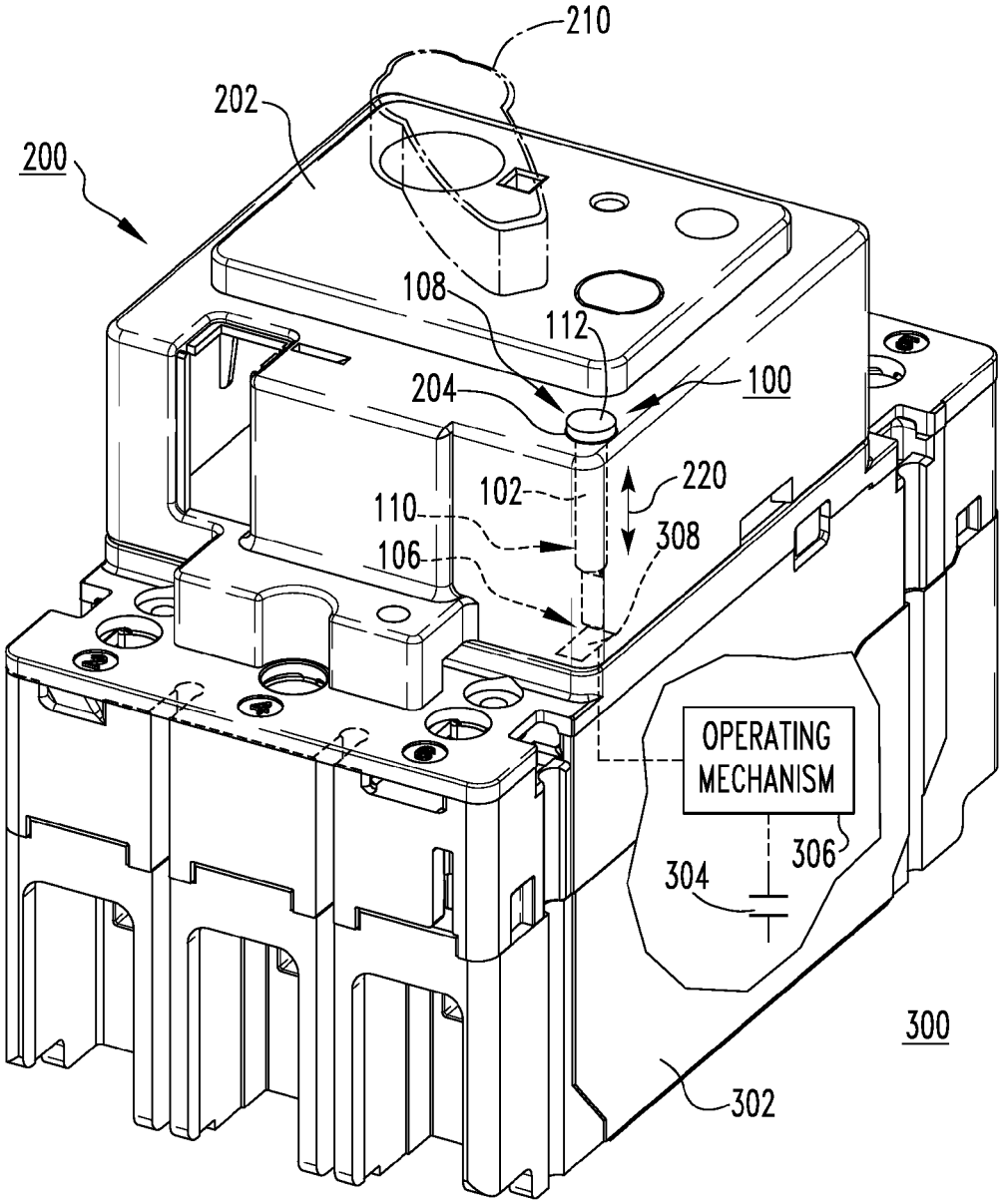
FIG. 2 is an isometric view of a circuit breaker, and handle assembly and push-to-trip mechanism therefor, in accordance with an embodiment of the disclosed concept.

FIG. 2 shows a push-to-trip mechanism 100 for a handle assembly 200 of an electrical switching apparatus 300 such as, for example and without limitation, the molded case circuit breaker 300, which is shown. In the example of FIG. 2, the circuit breaker 300 includes a housing 302, separable contacts 304 (shown in simplified form) enclosed by the housing 302, and an operating mechanism 306 (shown in simplified form) for opening and closing the separable contacts 304. The operating mechanism 306 includes a push-to-trip button 308 (shown in hidden line drawing in FIG. 2), which is operable to trip open the separable contacts 304 in a generally well known manner.

The handle assembly 200 includes a casing 202, which is coupled to the exterior of the circuit breaker housing 302 over the push-to-trip button 308 and fastened to the circuit breaker 300 using any known or suitable fastener or fastening mechanism. In the example of FIG. 2, the handle assembly is a rotatable handle attachment 200 including a rotating handle 210 (shown in phantom line drawing), although it will be appreciated that the push-to-trip mechanism 100 could be employed with any known or suitable alternative type and/or configuration of handle assembly (not shown) and/or electrical switching apparatus (not shown), without departing from the scope of the disclosed concept. Continuing to refer to FIG. 2, and also to FIG. 3, it will be appreciated that the casing 202 of the handle assembly 200 includes an aperture 204. Specifically, as best shown in FIG. 2, when the handle assembly casing 202 is fastened to the circuit breaker housing 302, the aperture 204 is preferably aligned with the push-to-trip button 308 of the circuit breaker 300.

Figure 3:
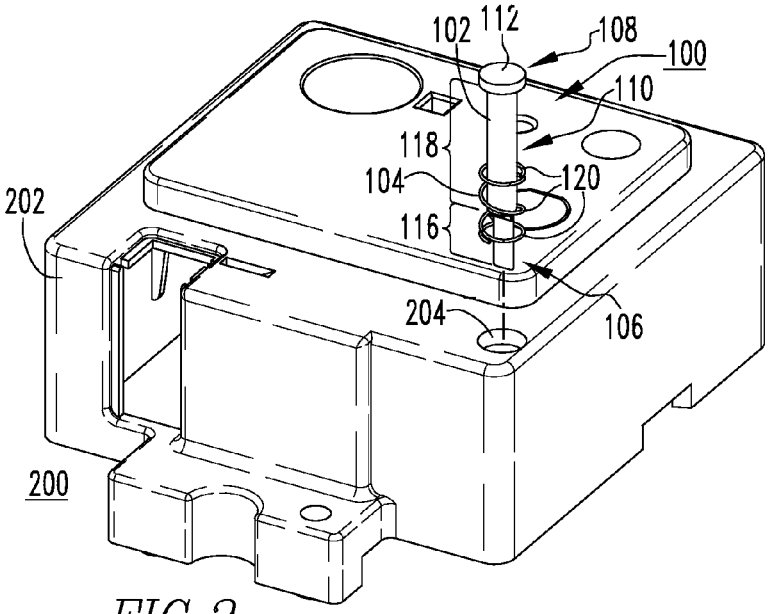
FIG. 3 is a partially exploded isometric view of the handle assembly and push-to-trip mechanism therefor of FIG. 2.

The push-to-trip mechanism 100 includes an actuating member 102 (substantially shown in hidden line drawing in FIG. 2), which is at least partially disposed within the aperture 204 of the handle assembly casing 202, as shown in FIG. 2. It will be appreciated, therefore, that the actuating member 102 is structured to move in the direction of arrow 220 (e.g., upward and downward from the perspective of FIG. 2), between an actuated position corresponding to the actuating member 102 actuating the push-to-trip button 308 (FIG. 2), and an unactuated position corresponding to the actuating member 102 not actuating the push-to-trip button 308. As shown in FIG. 3, the push-to-trip mechanism 100 also preferably includes a resilient element 104 such as, for example and without limitation, the spring 104, which is shown. The spring 104 or other suitable resilient element (not shown) biases the actuating member 102 toward the aforementioned unactuated position.

Figure 5:
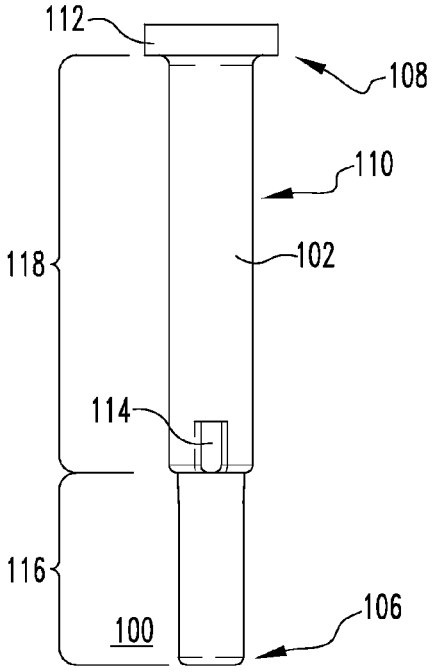
FIG. 5 is a front elevation view of the push-to-trip mechanism of FIG. 4.
Figure 6:
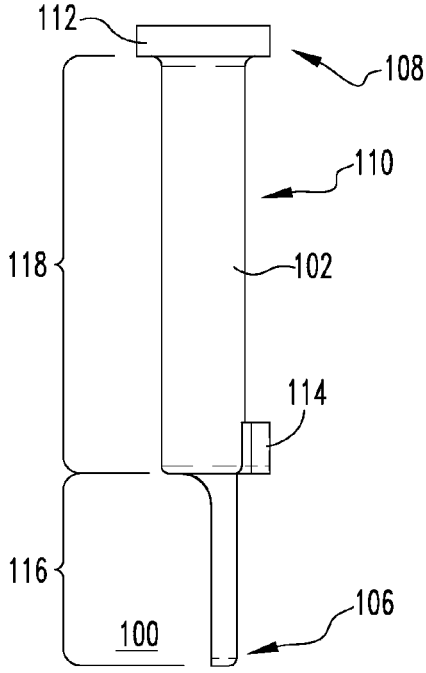
FIG. 6 is a side elevation view of the push-to-trip mechanism of FIG. 5.
Figure 7:
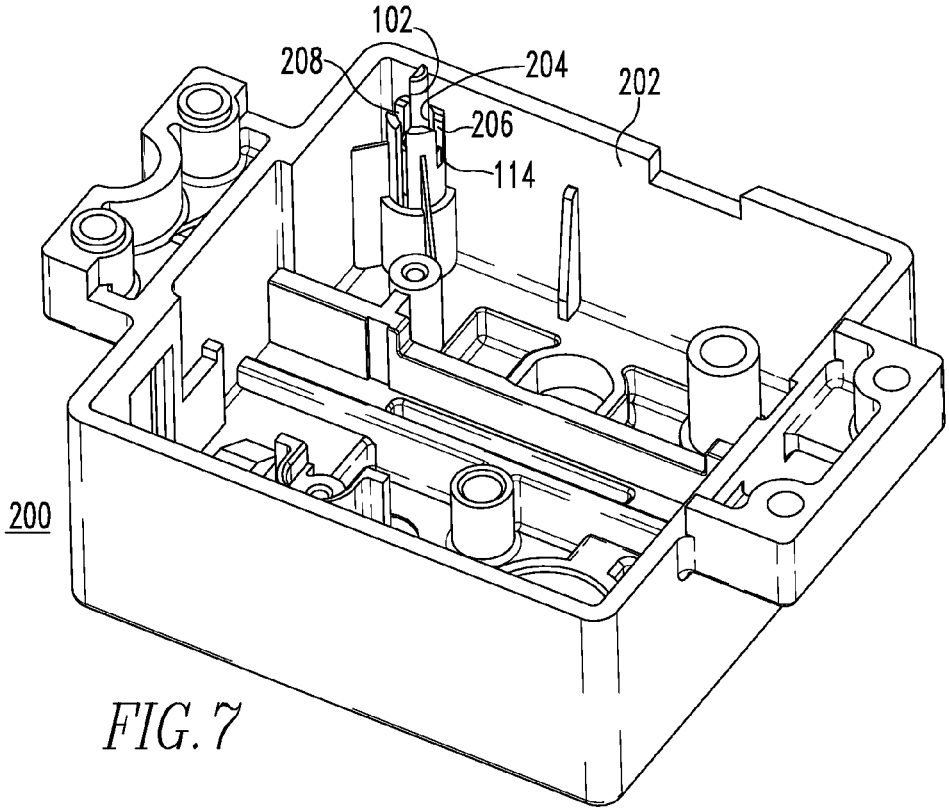
FIG. 7 is a bottom isometric view of the handle assembly, showing a portion of the push-to-trip mechanism disposed in a first position in accordance with an embodiment of the disclosed concept.
Figure 8:
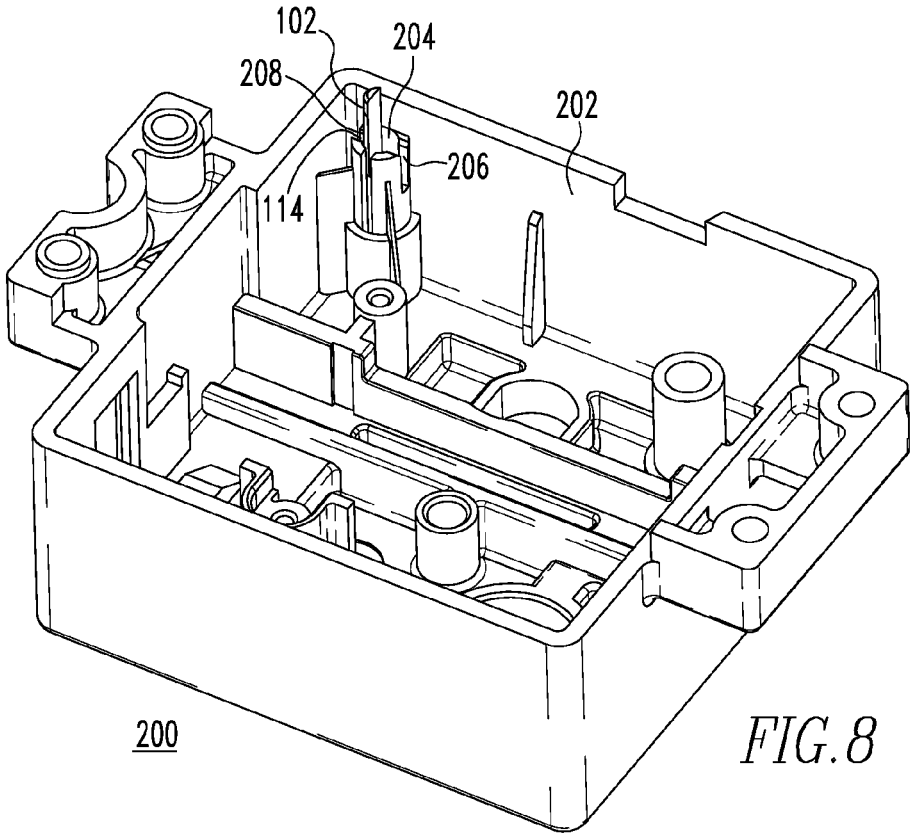
FIG. 8 is a bottom isometric view of the handle assembly of FIG. 7 modified to show the push-to-trip mechanism in a second, different position in accordance with another embodiment of the disclosed concept.

The push-to-trip mechanism 100 and, in particular, the actuating member 102 thereof, will now be described in greater detail with reference to FIGS. 3-6. Specifically, in the non-limiting example shown and described herein, the actuating member 102 includes first and second opposing ends 106,108, and an elongated intermediate portion 110 extending therebetween. The first end 106 is structured to extend through the aperture 204 of the casing 202, as best shown in FIGS. 7 and 8, to cooperate with the push-to-trip button 308 of the circuit breaker 300, as previously described hereinabove with respect to FIG. 2. The second end 108 is structured to be accessible from the exterior of the handle assembly casing 202. More specifically, the second end 108 of the example actuating member 102 includes an enlarged head 112, which is readily accessible from the exterior of the handle assembly 200, as shown in FIG. 2. In this manner, a user can relatively quickly and easily actuate (e.g., without limitation, depress downwardly in the direction of arrow 220 from the perspective of FIG. 2) the actuating member 102 to, in turn, actuate the push-to-trip button 308 of the circuit breaker 300, without removing the handle assembly casing 202 or otherwise struggling to effectively actuate the push-to-trip button 308.

Figure 4:
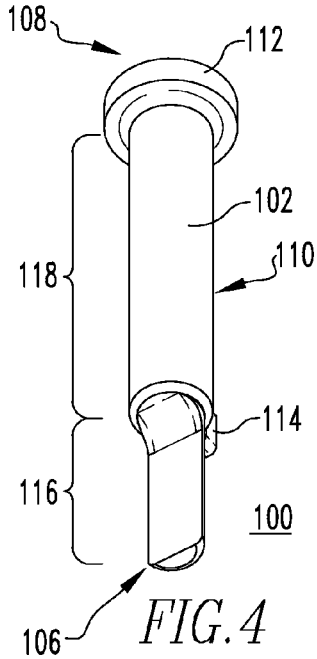
FIG. 4 is an isometric view of the push-to-trip mechanism of FIG. 3.

As shown in the exploded view of FIG. 3, the exemplary spring 104 includes a plurality of coils 120. The actuating member 102 extends through the coils 120 of the spring 104 such that, when the push-to-trip mechanism 100 is coupled to the handle assembly casing 202, the second section 118 of the actuating member 102 extends through, and is disposed within, the coils 120, as shown. FIGS. 4-6 show the first and second sections 116,118 of the elongated intermediate portion 110 of the actuating member 102 in greater detail. Specifically, the first section 116 is disposed at or about the first end 106 of the actuating member 102, and the second section 118 extends between the first section 116 and the second end 108. As best shown in the example of FIG. 4, the first section preferably has a D-shaped cross-section, and the second section 118 preferably has a circular cross-section. Among other advantages, this unique shape allows the disclosed push-to-trip mechanism 100 to be relatively quickly and easily configured to be employed with a wide variety of different electrical switching apparatus, as described in greater detail hereinbelow.

Continuing to refer to FIGS. 4-6, and also to FIGS. 7 and 8, it will be appreciated that the actuating member 102 further comprises a protrusion 114, which extends outwardly from the elongated intermediate portion 110 of the actuating member 102, as best shown in FIGS. 4 and 6. The protrusion 114 is structured to cooperate with a portion 206,208 of the casing 202 of the handle assembly 200, in order to position the actuating member 102 in a desired orientation with respect to the push-to-trip button 308 (FIG. 2) of the circuit breaker 300 (FIG. 2). More specifically, as shown in FIGS. 7 and 8, the handle assembly casing 202 preferably includes a number of recesses such as, for example and without limitation, the first and second slots 206,208, shown. The actuating member 102 is pivotable among a plurality of positions wherein, in one of the positions, the aforementioned protrusion 114 of the elongated member 102 is movably disposed in the first recess 206, as shown in FIG. 7. In this configuration, the actuating member 102 is cooperable with a certain type or types of push-to-trip button(s) of certain type(s) of electrical switching apparatus (see, for example and without limitation, push-to-trip button 308 of molded case circuit breaker 300 in FIG. 2). It will, however, be appreciated that the disclosed push-to-trip mechanism 100 and, in particular, the unique elongated member 102, protrusion 114 and recess 206,208 configuration thereof, enables the actuating member 102 to be moved (e.g., without limitation, pivoted) to a number of other, different positions to properly configure the actuating member 102 to suitable cooperate with a variety of other, different push-to-trip buttons (not shown) and/or other mechanisms (not shown) of any other known or suitable electrical switching apparatus (not shown). By way of example, and without limitation, FIG. 8 shows the actuating member 102 having been pivoted to a different position with respect to the handle assembly casing 202, wherein the protrusion 114 is disposed in the second recess 208. Thus, the actuating member 102 is disposed in a second, different desired orientation. Accordingly, in the non-limiting examples of FIGS. 7 and 8, which are provided solely for purposes of illustration and are not meant to be limiting upon the scope of the disclosed concept, it will be appreciated that the push-to-trip mechanism 100 and, in particular, the actuating member 102 therefor, can be configured in at least two different orientations, which in the examples shown, are substantially 180 degrees apart from one another.

Accordingly, the disclosed handle assembly 200 and push-to-trip mechanism 100 therefor, provide an efficient and effective mechanism for suitably actuating the push-to-trip button 308 (shown in hidden line drawing) of a circuit breaker 300 (FIG. 2) or other suitable electrical switching apparatus (not shown), without requiring the casing 202 of the handle assembly 200 to be removed from the circuit breaker 300. Additionally, the operating member 102 of the push-to-trip mechanism 100 can be relatively quickly and easily configured in a variety of different positions and orientations, in order to effectively cooperate with a variety of different push-to-trip buttons (e.g., without limitation, push-to-trip button 308 of FIG. 2) or other mechanisms (not shown) of a wide variety of different electrical switching apparatus (e.g., without limitation, circuit breaker 300 of FIG. 2).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A push-to-trip mechanism for a handle assembly for an electrical switching apparatus, said electrical switching apparatus including a housing, separable contacts enclosed by the housing, and a push-to-trip button being operable to trip open said separable contacts, said handle assembly including a casing having an aperture, said casing being coupled to the exterior of the housing over said push-to-trip button, said push-to-trip mechanism comprising:

an actuating member structured to be at least partially disposed within the aperture of said casing, said actuating member being structured to move between an actuated position corresponding to said actuating member actuating said push-to-trip button, and an unactuated position corresponding to said actuating member not actuating said push-to-trip button; and a resilient element biasing said actuating member toward said unactuated position, wherein said actuating member comprises a first end, a second end disposed opposite and distal form the first end, and an elongated intermediate portion extending between the first end and the second end; wherein the first end is structured to extend through the aperture of said casing to cooperate with said push-to-trip button; and wherein the second end is structured to be accessible from the exterior of said casing, wherein said actuating member further comprises a protrusion; wherein said protrusion extends outwardly from said elongated intermediate portion; and wherein protrusion is structured to cooperate with a portion of said casing in order to position said actuating member in a desired orientation with respect to said push-to-trip button, and wherein said casing includes a first recess and a second recess; wherein said actuating member is pivotable among a plurality of positions; wherein in one of said positions said protrusion is structured to be disposed in said first recess; wherein in another, different one of said positions said protrusion is structured to be disposed in said second recess; wherein, when said protrusion is disposed in said first recess, said actuating member is positioned in a first desired orientation; and wherein, when said protrusion is disposed in said second recess, said actuating member is disposed in a second, different desired orientation.

2. The push-to-trip mechanism of claim 1 wherein the second end of said actuating member includes an enlarged head.

3. The push-to-trip mechanism of claim 1 wherein said elongated intermediate portion includes a first section disposed at or about the first end, and a second section extending between the first section and the second end; wherein said first section has a D-shaped cross section; and wherein said second section has a circular cross section.

4. The push-to-trip mechanism of claim 3 wherein said resilient element is a spring; wherein said spring includes a plurality of coils; and wherein said second section is structured to extend through said coils.

5. A handle assembly for an electrical switching apparatus, said electrical switching apparatus including a housing, separable contacts enclosed by the housing, and a push-to-trip button being operable to trip open said separable contacts, said handle assembly comprising:

a casing having an aperture, said casing being structured to be coupled to the exterior of the housing over said push-to-trip button; and a push-to-trip mechanism comprising:

an actuating member at least partially disposed within the aperture of said casing, said actuating member being structured to move between an actuated position corresponding to said actuating member actuating said push-to-trip button, and an unactuated position corresponding to said actuating member not actuating said push-to-trip button, and a resilient element biasing said actuating member toward said unactuated position, wherein said actuating member of said push-to-trip mechanism comprises a first end, a second end disposed opposite and distal from the first end, and an elongated intermediate portion extending between the first end and the second end; wherein the first end is structured to extend through the aperture of said casing to cooperate with said push-to-trip button; and wherein the second end is accessible from the exterior of said casing, wherein said actuating member of said push-to-trip mechanism further comprises a protrusion; wherein said protrusion extends outwardly from said elongated intermediate portion; and wherein said protrusion cooperates with a portion of said casing in order to position said actuating member in a desired orientation with respect to said push-to-trip button, and wherein said casing includes a first recess and a second recess; wherein said actuating member is pivotable among a plurality of positions; wherein in one of said positions said protrusion is disposed in said first recess; wherein in another, different one of said positions said protrusion is disposed in said second recess; wherein, when said protrusion is disposed in said first recess, said actuating member is positioned in a first desired orientation; and wherein, when said protrusion is disposed in said second recess, said actuating member is disposed in a second, different desired orientation.

6. The handle assembly of claim 5 wherein the second end of said actuating member includes an enlarged head.

7. The handle assembly of claim 5 wherein said elongated intermediate portion includes a first section disposed at or about the first end, and a second section extending between the first section and the second end; wherein said first section has a D-shaped cross section; and wherein said second section has a circular cross section.

8. The handle assembly of claim 7 wherein said resilient element is a spring; wherein said spring includes a plurality of coils; and wherein said second section extends through said coils.

9. an electrical switching apparatus comprising:

a housing;

separable contacts enclosed by the housing;

a push-to-trip button being operable to trip open said separable contacts; and a handle assembly comprising:

a casing having an aperture, said casing being coupled to the exterior of the housing over said push-to-trip button, and a push-to-trip mechanism comprising:

an actuating member at least partially disposed within the aperture of said casing, said actuating member being movable between an actuated position corresponding to said actuating member actuating said push-to-trip button, and an unactuated position corresponding to said actuating member not actuating said push-to-trip button, a resilient element biasing said actuating member toward said unactuated position wherein said actuating member of said push-to-trip mechanism comprises a first end, a second end disposed opposite and distal from the first end, and an elongated intermediate portion extending between the first and the second end; wherein the first end extends through the aperture of said casing to cooperate with said push-to-trip button; and wherein the second end is accessible from the exterior of said casing, wherein said actuating member of said push-to-trip mechanism further comprises a protrusion; wherein said protrusion extends outwardly from said elongated intermediate portion; and wherein said protrusion cooperates with a portion of said casing in order to position said actuating member in a desired orientation with respect to said push-to-trip button, and wherein said casing of said handle assembly includes a first recess and a second recess; wherein said actuating member is pivotable among a plurality of positions; wherein in one of said positions said protrusion is disposed in said first recess; wherein in another, different one of said positions said protrusion is disposed in said second recess; wherein, when said protrusion is disposed in said first recess, said actuating member is positioned in a first desired orientation; and wherein, when said protrusion is disposed in said second recess, said actuating member is disposed in a second, different desired orientation.

10. The electrical switching apparatus of claim 9 wherein said elongated intermediate portion includes a first section disposed at or about the first end, and a second section extending between the first section and the second end; wherein said first section has a D-shaped cross section; and wherein said second section has a circular cross section.

11. The electrical switching apparatus of claim 10 wherein said resilient element is a spring; wherein said spring includes a plurality of coils; and wherein said second section extends through said coils.

12. The electrical switching apparatus of claim 9 wherein said electrical switching apparatus is a circuit breaker; wherein said handle assembly is a rotary handle attachment; and wherein said push-to-trip mechanism is operable from the exterior of said casing in order to actuate said push-to-trip button of said circuit breaker, without removing said casing.

* * * * *